United States Patent [19]

Sommer

[11] Patent Number: 4,824,410

[45] Date of Patent: Apr. 25, 1989

[54] JOINT FOR TOY FIGURES, ESPECIALLY STUFFED BEARS

[75] Inventor: Rüdiger Sommer, Neustadt, Fed. Rep. of Germany

[73] Assignee: Plüco Spielwaren GmbH, Neustadt, Fed. Rep. of Germany

[21] Appl. No.: 149,662

[22] Filed: Jan. 28, 1988

[30] Foreign Application Priority Data

Feb. 3, 1987 [DE] Fed. Rep. of Germany ..... 3703284

[51] Int. Cl.[4] ..... A63H 3/46

[52] U.S. Cl. ..... 446/371; 446/376

[58] Field of Search ..... 446/371, 369, 370, 372, 446/375, 376, 384; 223/66, 68; 411/508, 509, 510, 533; 403/164, 165, 161, 162

[56] References Cited

U.S. PATENT DOCUMENTS

| | | | |
|---|---|---|---|
| 1,709,432 | 4/1929 | Hill | 446/371 |
| 2,653,415 | 9/1953 | Becker | 446/376 |
| 3,818,631 | 6/1974 | Cederholm | 446/371 |
| 4,662,857 | 5/1987 | Quinn et al. | 446/371 |

FOREIGN PATENT DOCUMENTS

| | | | |
|---|---|---|---|
| 1049752 | 1/1959 | Fed. Rep. of Germany | 446/371 |
| 1417044 | 9/1965 | France | 446/371 |

*Primary Examiner*—Mickey Yu

*Attorney, Agent, or Firm*—Max Fogiel

[57] ABSTRACT

A device for articulating the limbs and head to the body of toy figures. The device consists essentially of plastic disks that grip the covering material and of a plastic bolt that extends through the disks and has barbed sections. The object is to facilitate assembly of the toy and establish a secure joint that will also be mobile. The bolt (8) has three essentially cylindrical securing sections (13, 14, and 15). Each section accommodates a disk (9, 10, and 11). The section (13) adjacent to the head (12) of the bolt accommodates a disk (9) with several rings of teeth (26) that engage similar teeth (27) that are displaced by half their width in relation to the first ring of teeth on the disk (10) accommodated on the adjacent section (14), gripping the fabric (6) that covers the limb (2) or head between them. The third disk (11), which secures the fabric (5) that covers the body (1), is in the shape of a bowl or cup and at least to some extent receives the two other disks (9 and 10). The bolt also has a longitudinal recess (23) that provides additional resilience.

13 Claims, 2 Drawing Sheets

Fig. 1
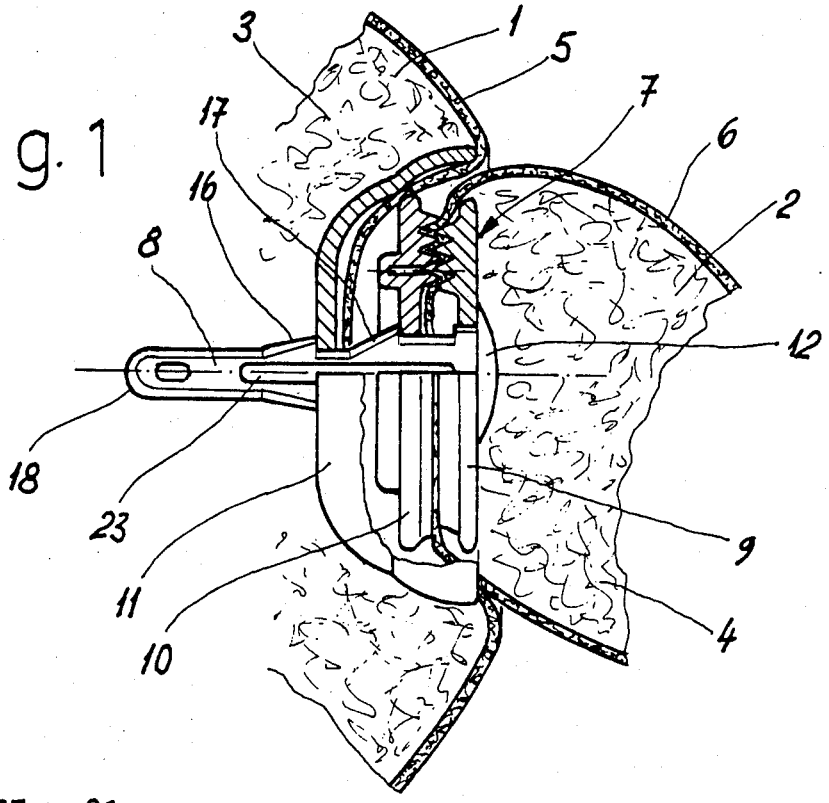
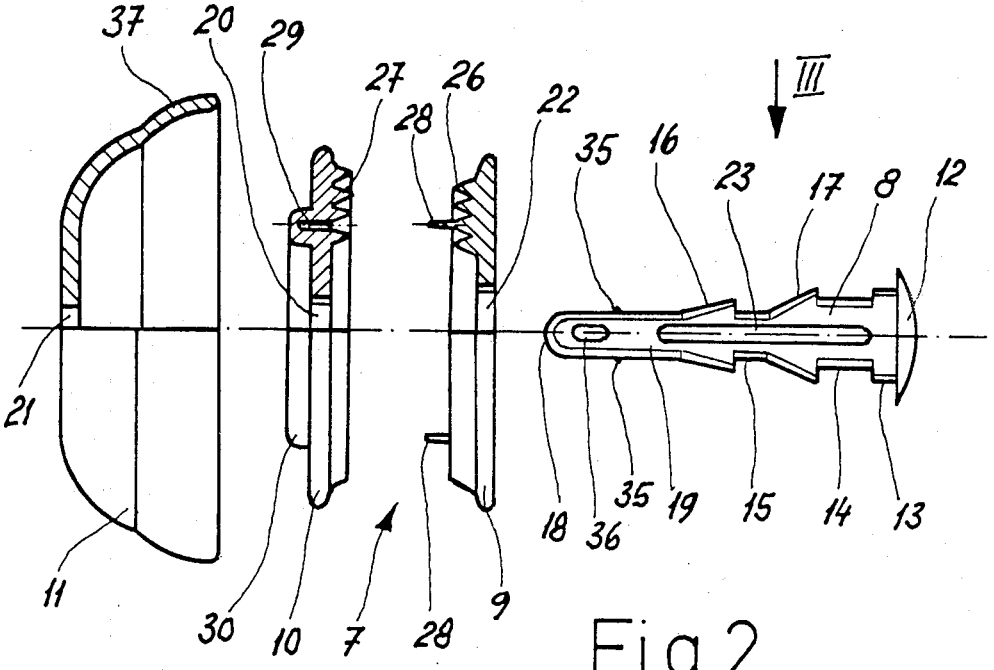
Fig. 2

Fig. 3
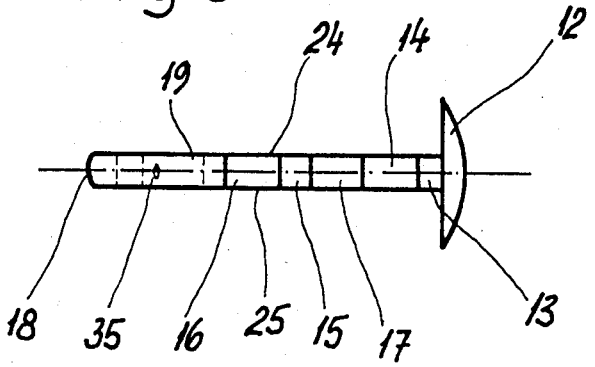
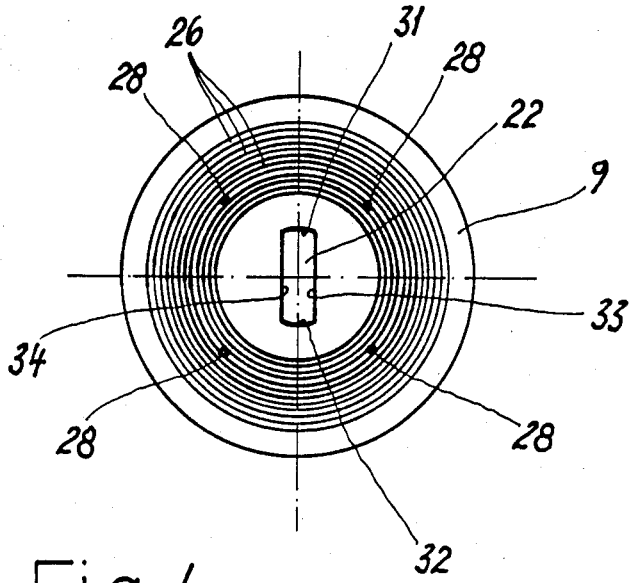
Fig. 4

JOINT FOR TOY FIGURES, ESPECIALLY STUFFED BEARS

The invention concerns a device for articulating the limbs and head to the body of toy figures, especially stuffed bears and consisting of plastic disks that grip the covering material and of a plastic bolt that extends through the disks and has barbed sections.

A joint for the extremities of a toy figure and consisting of two disks held together by a bolt is known from German OS No. 3 338 643. The two disks and the bolt, which can be in one piece with one of them, are made out of plastic. The bolt can be locked into one of the disks by means of barblike annular grooves around the bolt and matching beads around the inside of a central sleeve in the disk. A similar joint, also plastic, is disclosed in German GM No. 1 912 424. The bolt, which has a barbed contour, is in one piece with one of the disks, which constitutes the head of the bolt, and tightly secures the other disk when it is slid over it. The bolt in the means of connecting parts of covered toy figures in accordance with German OS No. 1 478 344 is in one piece with one of the disks and has a groove around it that the other disk snaps into and is secured in. The grip exerted by the disks, between which are secured the cloth coverings of the parts of the figures that are to be connected together, depends on a large extent in these known joints that utilize bolts with barbed sections on the axial force exerted during the assembly process to slide the disks onto the bolts. If only a slight force is applied, the joint will be too loose. If on the other hand the force is too powerful, the joint may be too tight and will not articulate well. Once the toy has been used for a while, the joint may wear out and no longer be able to fulfill its function. There is also a danger associated with playing with the toy that the limbs attached to its body with one of the known joints can be torn off because they are too weak to withstand the amount of force applied. The one-piece design of the bolt and disk entails the drawback that a separate tool must be provided for each size of toy, which makes manufacturing more expensive in that the tools are relatively complicated. Since a total of five joints are necessary to attach the limbs and head, even slight increases in the cost of the joints will make the toys significantly more expensive.

The object of the present invention is to improve the device for articulating the parts of a toy figure together to the extent that it will be easy to manufacture, will have a long life, and will resist even powerful destructive forces. The figure will be easy to assemble with the joint and the parts reliably attached and moving easily.

This object is attained by means of the characteristics recited in the body of claim 1, with the subsidiary claims reciting practical and advanced developments that additionally contributed to attaining the object.

The bolt that is part of the joint and that is made out of plastic accordingly features three essentially cylindrical sections for securing a total of three disks, two of which are provided with rings of teeth on the mutually facing sides that engage each other and grip the fabric covers of the limbs and head of the toy, whereas the third disk partly or in a practical way completely overlaps the two other disks and grips the fabric that covers the body. The two disks that have the rings of teeth in one preferred embodiment of the invention also have several axially projecting arbors that extend through and secure the fabric covering the limbs and accordingly essentially facilitate assembling the toy. Subsequent to assembly these arbors engage matching bores in the other associated disk. The particular position overall and in relation to each other of the sections that secure the disks and their particular design will ensure unobjectionable gripping and securing of the fabric coverings and hence of the limbs and and head to the body while retaining maximum mobility. Once the bolt has been forced into the disks or once the disks have been force over the bolt, no further assembly—welding, bending, stretching, etc.—will be necessary. The joints will all be essentially equally and long-lastingly mobile and will retain their grip and attachment.

The bolt or the shaft of the bolt in accordance with another characteristic of the invention has a recess in the the form of a slot. This increases the resilience ensured by the plastic so that the barbed sections will yield readily when the disks are forced over the bolt and, once they have snapped back into their original state, will axially secure and lock the disks. The diameter of the demarcating section at the head of the bolt that secures the disk positioned at that point is longer than that of the adjacent securing section and more or less as long as the longest outside diameter of the adjacent barbed section of the bolt, so that the innermost disk can easily be forced over the bolt. The diameter of the section that secures the third disk is in turn shorter than that of the previous section that accommodates the second disk. The diameters of the securing sections accordingly decrease in steps from the head of the bolt out, and the barbed sections have matching steps. The shaft of the bolt also has in a practical way two opposite and parallel slopes, so that the cross-section of the shaft is demarcated by two parallel flat sides and two diametrically opposed cylindrical parts. The central securing bores of the two mutually operating disks with rings of teeth are designed to match, so that their circumferential position in relation to each other is fixed because their cross-section matches that of the shaft of the bolt and prevents them from turning circumferentially.

One embodiment of the invention will now be described with reference to the drawing, wherein FIG. 1 is a side view, half in longitudinal section, of the joint, FIG. 2 is a partly longitudinally sectional exploded view of the joint, FIG. 3 is a view of the bolt component of the joint along the direction indicated by the arrow III in FIG. 2, and FIG. 4 is a top view of one of the two disks that operate in conjunction.

FIG. 1 is a truncated and sectional view of the body 1 and arm 2 of a toy figure. The stuffing 3 of the body and the stuffing 4 of arm 2 are covered with a fabric 5 and 6 consisting of plush. Arm 2 is securely attached to body 1 by means of a joint 7 that allows the arm to move freely in relation to the body.

As will be evident in particular from FIG. 2, joint 7 consists of a plastic bolt 8 and of three disks 9, 10, and 11 that are also made out of plastic and can be or have been forced over the bolt. Bolt 8 has a head 12 and three essentially cylindrical sections 13, 14, and 15 for securing disks 9, 10, and 11. It also has two more or less barbed sections 16 and 17, with barbed section 16 in the vicinity of the rounded-off point 18 of bolt 8 and barbed section 17 positioned between cylindrical securing sections 14 and 15. Barbed sections 16 and 17 converge toward point 18. The diameters of cylindrical securing sections 13, 14, and 15 are stepped down such that securing section 13 has the longest diameter, securing section 14 a slightly shorter diameter, and securing section 15 the shortest diameter. The radially outside dimensions of barbed sections 16 and 17 are also stepped to facilitate forcing securing disks 9, 10, and 11 over the shaft 19 of bolt 8. The radially outside dimensions of barbed section 17 are approximately the same as or slightly smaller than the inside dimensions of the central bore 22 in disk 9, whereas the radially outside dimensions of barbed section 16 are equal to or slightly smaller than the inside dimensions of the central bore 20 in disk 10. The diameter of the central bore 21 in disk 11 is in turn shorter than that of central bores 20 and 22 and approximately as long as the diameter of securing section 15.

Securing disks 9, 10, and 11 can easily be forced over the shaft 19 of bolt 8 by exploiting the resilience of the plastic that the bolt and disks are made out of. To augment the resilience of the barbs in sections 16 and 17 and allow the disks to be forced over them and rest firmly over the associated securing sections 13, 14, and 15 and axially against barbed sections 16 and 17 there is an axial recess 23 in bolt 8. As will be evident in particular from FIG. 3, two diametrically opposed and parallel surfaces 24 and 25 of the shaft 19 of bolt 8 extend over the total length of the shaft from its point 18 to its head 12. Recess 23 extends perpendicular to slopes 24 and 25 in the vicinity of barbed sections 16 and 17.

The two disks 9 and 10, which have more or less the same outside diameter, have several teeth or rings 26 and 27 of teeth on their mutually facing surfaces. The illustrated embodiment has four concentric rings 26 and 27 of teeth (see also FIG. 4). The disks can of course, if they are large enough, have additional rings. The teeth in rings 26 and 27 are sharply pointed and the teeth in ring 26 are radially displaced half of their width in relation to the teeth in ring 27, so that they will engage when the two disks 9 and 10 are positioned together. Once the toy has been assembled the fabric 6 covering arm 2 is secured between rings 26 and 27 of teeth and accordingly gripped between disks 9 and 10, as will also be evident from FIG. 1. The third disk 11 is shaped more or less like a bowl or cup and, once the toy has been assembled, will overlap disks 9 and 10, gripping and securing the fabric 5 covering body 1, with joint 7 producing a reliable but freely rotating articulation between arm 2 and body 1. The dimensions and mutual distance between securing sections 13, 14, and 15 are selected to ensure a reliable grip on fabrics 5 and 6 on the part of disks 9, 10, and 11 while allowing complete rotation of arm 2 on body 1. Disks 9, 10, and 11 can be kept on hand in various sizes depending on the size of the toy, whereas on and the same size of bolt will always be employed. This makes the joint essentially easier to manufacture.

To improve the grip on fabric 6 while the toy is being assembled, disk 9 has several, preferably four, arbor-like, axial, and symmetrically distributed projections 28 (see also FIG. 4). Projections 28 extend through fabric 6 and, once the toy has been assembled, engage matching bores 29 in disk 10. Disk 10 is also provided with a continuous annular bead 30, into which the blind bores 29 extend. To ensure that projections 28 arrive precisely in their associated bores 29 while joint 7 is being fitted together, while, that is, disks 9 and 10 are being approached and forced over the bolt, the central bores 20 and 22 in disks 9 and 10 match the cross-section of shaft 19, meaning that each bore is flattened at the side. This will be evident from FIG. 4. Central bores 20 and 22 are accordingly demarcated by two diametrically opposed arcs of a circle and by two straight sides 33 and 34 that extend parallel from one arc to the other, preventing disks 9 and 10 from rotating while they are being forced over shaft 19.

Assembly is further facilitated by two radially slightly projecting securing elevations 35 that, once disk 11 has been forced over the bolt, prevent it from sliding off before it can be forced beyond barbed section 16 to come to rest against securing section 15. Also evident is another continuous bore 36 in the vicinity of point 18. A hooked component on the unillustrated assembly tool engages bore 36 while the toy is being assembled. Third disk 11, which is essentially shaped like a bowl or cup, will now be briefly described. It has at the edge an enlarged convexity 37 that, once the toy has been assembled (see FIG. 1) completely receives the two other disks 9 and 10. The bore 21 through the center of disk 11 has a circular cross-section.

Toys that are manufactured with the aforesaid joint are completely washable, and the joint will not rust or dissolve. The joint is also resistant to heat and will retain its desirable properties, specifically unobjectionable attachment of the limbs and head to the body while ensuring maximum mobility, even subject to long-term use.

I claim:

1. A device for articulating limbs and head to a body of toy figures, particularly stuffed animals, comprising: a body portion having a recessed concave shape covered with fabric; a movable member extending into said recessed concave shape and covered with fabric; a bolt having a head and three substantially cylindrical barbed securing sections; a first disk for mounting on a first of said sections adjacent the head of said bolt and having a plurality of rings of teeth; a second disk for mounting on a second of said sections adjacent said first section and having teeth engaging the teeth on said first disk, the teeth on said second disk being displaced by half their width in relation to the teeth on said first disk; the fabric on said movable member being gripped between the teeth on said first disk and the teeth on said second disk; and a third disk for securing the fabric covering said body portion with said movable member and having a bowl-shape receiving at least a part of said first and second disks and being seated on the third of said sections.

2. A device as defined in claim 1, wherein said securing sections have stepped-down diameters, said first section adjacent said bolt head having the longest diameter, said second section having a medium-length diameter, and said third section having the shortest diameter, said third section being separated from said second section by a barbed section.

3. A device as defined in claim 1, wherein said first disk rests axially against said bolt head, said second disk resting axially against a barbed section separating said second securing section from said third ensuring section, said third disk being axially secured adjacent a point of said bolt by another barbed section.

4. A device as defined in claim 1, including arbor-shaped projections on said first disk, said projections extending through said gripping fabric and into matching bores in said second disk when the toy is assembled.

5. A device as defined in claim 4, including an annular bead on said second disk having said matching bores, said bores being blind bores.

6. A device as defined in claim 1, wherein said bolt has two diametrically opposed parallel surfaces extending from said bolt head to a point of said bolt.

7. A device as defined in claim 6, wherein said bolt has a shaft with two parallel straight sides and two mutually opposed circular arcs in cross-section, said first disk and said second disk having central securing bores matching the cross-section of said shaft, the central securing bore in said first disk having a longest diameter and said second disk having a longest diameter in its central securing bore, the longest diameter of the securing bore in said first disk being longer than the longest diameter of the securing bore in said second disk.

8. A device as defined in claim 6, wherein said bolt has a slot-shaped recess extending axially and perpendicular to said surfaces.

9. A device as defined in claim 1, wherein said bolt has a rounded-off point.

10. A device as defined in claim 1, including a barbed section separating said first securing section from said second securing section and having a longest outside diameter, said first disk having a central securing bore with a longest diameter which is greater than said longest outside diameter of said barbed section; another barbed section adjacent said third securing section and having a longest outside diameter, said second disk having a central securing bore with a longest diameter greater or equal to said longest outside diameter of said other barbed section.

11. A device as defined in claim 1, wherein said first and second disks have the same outside diameters.

12. A device as defined in claim 1, wherein said third disk has an augmented convexity receiving said first disk and said second disk.

13. A device as defined in claim 1, wherein said bolt has a point; and two diametrically opposed elevations in the vicinity of said point of said bolt.

* * * * *